US011443693B2

(12) United States Patent
Takasugi

(10) Patent No.: US 11,443,693 B2
(45) Date of Patent: Sep. 13, 2022

(54) DISPLAY CONTROL DEVICE, DISPLAY DEVICE AND METHOD OF CONTROLLING DISPLAY DEVICE

(71) Applicant: LG DISPLAY CO., LTD., Seoul (KR)

(72) Inventor: Shinji Takasugi, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/068,255

(22) Filed: Oct. 12, 2020

(65) Prior Publication Data

US 2021/0118369 A1 Apr. 22, 2021

(30) Foreign Application Priority Data

Oct. 17, 2019 (JP) ..... JP2019-190198

(51) Int. Cl.
*G09G 3/3258* (2016.01)
*G09G 3/3275* (2016.01)
*G09G 3/3266* (2016.01)

(52) U.S. Cl.
CPC ..... *G09G 3/3258* (2013.01); *G09G 3/3266* (2013.01); *G09G 3/3275* (2013.01); *G09G 2300/0426* (2013.01); *G09G 2310/08* (2013.01); *G09G 2320/0252* (2013.01); *G09G 2320/10* (2013.01)

(58) Field of Classification Search
None
See application file for complete search history.

(56) References Cited

U.S. PATENT DOCUMENTS 6,181,312 B1 * 1/2001 Sekine ..... G09G 3/3677 345/98
9,728,130 B2 * 8/2017 Takahara ..... G09G 3/3258
2003/0001983 A1 * 1/2003 Nose ..... G09G 3/3406 349/61
2003/0169247 A1 * 9/2003 Kawabe ..... G09G 3/342 345/204

(Continued)

FOREIGN PATENT DOCUMENTS

KR 10-2018-0060530 A 6/2018
KR 10-2018-0127896 A 11/2018

OTHER PUBLICATIONS

Office Action dated Dec. 30, 2020, issued in corresponding Korean Intellectual Property Office No. 10-2020-002089.

*Primary Examiner* — Nitin Patel
*Assistant Examiner* — Amen W Bogale
(74) *Attorney, Agent, or Firm* — Morgan, Lewis & Bockius LLP

(57) ABSTRACT

A display control device for controlling a display device including a display panel having a plurality of pixels arranged in rows and columns includes: a first driving unit supplying a data voltage corresponding to a luminance to the pixels by the columns; and a second driving unit selecting the pixels receiving the data voltage by the rows, wherein the first driving unit and the second driving unit, in one frame: sequentially supply the data voltage for an image display to the pixels of a first block including a first group of the rows; supply a black level voltage to the pixels of a second block including a second group of the rows; and supply the black level voltage to the pixels in at least one of the rows of the first block while the black level voltage is supplied to the pixels of the second block.

12 Claims, 12 Drawing Sheets

(56) References Cited

U.S. PATENT DOCUMENTS

2004/0048069 A1* 3/2004 Yamada ..... G09G 3/325 428/411.1
2005/0168491 A1* 8/2005 Takahara ..... G09G 3/3283 345/690
2005/0253794 A1* 11/2005 Lee ..... G09G 3/3648 345/87
2006/0022933 A1* 2/2006 Endo ..... G09G 3/3614 345/98
2006/0028463 A1* 2/2006 Nakamura ..... G09G 3/3677 345/204
2006/0033696 A1* 2/2006 Nakamura ..... G09G 3/3659 345/100
2006/0038767 A1* 2/2006 Nakamura ..... G09G 3/3677 345/100
2006/0164380 A1* 7/2006 Yang ..... G09G 3/3677 345/103
2007/0030219 A1* 2/2007 Park ..... G09G 3/3233 345/76
2008/0024404 A1* 1/2008 Tanaka ..... G09G 3/3648 345/87
2008/0111812 A1* 5/2008 Shirasaki ..... G09G 3/3291 345/212
2008/0238897 A1* 10/2008 Kimura ..... G09G 3/3666 345/204
2009/0085849 A1* 4/2009 Chung ..... G09G 3/3648 345/89
2009/0128723 A1* 5/2009 Saito ..... G09G 3/3688 345/96
2009/0160845 A1* 6/2009 Jang ..... G09G 3/3677 345/87
2009/0213056 A1* 8/2009 Nam ..... G09G 3/3648 345/90
2009/0243995 A1* 10/2009 Kimura ..... G09G 3/342 345/102
2009/0244041 A1* 10/2009 Choe ..... G09G 3/3659 345/90
2009/0273555 A1* 11/2009 Song ..... G09G 3/3688 345/96
2010/0134451 A1* 6/2010 Cho ..... G09G 3/3677 345/205
2010/0265218 A1* 10/2010 Chang ..... G09G 3/3648 345/204
2011/0267325 A1* 11/2011 Xi ..... G09G 3/3648 345/98
2012/0050240 A1* 3/2012 Tanaka ..... G09G 3/3666 345/204
2012/0249518 A1* 10/2012 Won ..... H04N 13/356 345/213
2012/0327137 A1* 12/2012 Saitoh ..... G09G 3/3648 345/690
2013/0120326 A1* 5/2013 Chung ..... G09G 3/3266 345/204
2013/0155124 A1* 6/2013 Tsuge ..... G09G 5/10 345/690
2013/0271441 A1* 10/2013 Ahn ..... G02F 1/13306 345/87
2014/0118422 A1* 5/2014 Shang ..... H04N 13/359 345/87
2015/0146141 A1* 5/2015 Kim ..... G09G 3/003 349/98
2016/0078834 A1* 3/2016 Hong ..... G11C 19/00 345/212
2017/0061878 A1* 3/2017 Park ..... G09G 3/3233
2017/0195658 A1* 7/2017 Jung ..... H04N 13/324
2018/0108299 A1* 4/2018 Nakamura ..... G09G 3/3258
2019/0189060 A1 6/2019 Takasugi
2019/0197959 A1* 6/2019 Noh ..... G09G 3/3266
2020/0020280 A1* 1/2020 Han ..... G09G 3/3266
2020/0074932 A1* 3/2020 Park ..... G09G 3/3291
2020/0074933 A1* 3/2020 Ban ..... G09G 3/3258
2020/0082762 A1* 3/2020 Takasugi ..... G09G 3/3266
2020/0152128 A1* 5/2020 Kim ..... G09G 3/3233
2020/0160781 A1* 5/2020 Park ..... G09G 3/3275
2020/0380906 A1* 12/2020 Kim ..... G09G 3/3258
2021/0005145 A1* 1/2021 Lee ..... G09G 3/3291
2021/0142753 A1* 5/2021 Wang ..... G09G 3/3677
2021/0193028 A1* 6/2021 Choi ..... G09G 3/32
2021/0201770 A1* 7/2021 Park ..... G11C 19/28
2021/0201814 A1* 7/2021 Choi ..... G09G 3/3266
2021/0201816 A1* 7/2021 Kim ..... G09G 3/3266
2021/0272505 A1* 9/2021 Kim ..... G09G 3/36
2021/0287608 A1* 9/2021 Min ..... G09G 3/3233

* cited by examiner

DISPLAY CONTROL DEVICE, DISPLAY DEVICE AND METHOD OF CONTROLLING DISPLAY DEVICE

CROSS REFERENCE TO RELATED APPLICATIONS

The present application claims the priority benefit of Japanese Patent Application No. 2019-190198 filed in the Japan Patent Office on Oct. 17, 2019, which is hereby incorporated by reference in its entirety for all purposes as if fully set forth herein.

BACKGROUND

Technical Field

The present invention relates to a display control device, a display device and a method of controlling a display device.

Discussion of the Related Art

An organic light emitting diode (OLED) display device is disclosed in a patent document 1 (Korean Patent Publication No. 10-2018-0127896). In the OLED display device of the patent document 1, a driving method of displaying a black image for a time period of one frame is adopted to reduce a motion picture response time (MPRT) and improve a display quality of a moving picture.

In a display device performing a black data insertion such as the OLED display device of the patent document 1, a writing time period per row is short because one frame includes a writing time period for a black data and a writing time period for an image data. As a result, it may be hard to obtain a sufficient writing time period of a data voltage for an image display.

SUMMARY

Accordingly, embodiments of the present invention are directed to a display control device, a display device and a method of controlling a display device that substantially obviate one or more of the problems due to limitations and disadvantages of the related art.

An object of the present invention is to provide a display control device, a display device and a method of controlling a display device where a display quality is improved and a sufficient writing time period of a data voltage for an image display is obtained due to a black data insertion.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described herein, a display control device for controlling a display device including a display panel having a plurality of pixels arranged in a plurality of rows and a plurality of columns comprises: a first driving unit supplying a data voltage corresponding to a luminance to the plurality of pixels by the plurality of columns; and a second driving unit selecting the plurality of pixels receiving the data voltage by the plurality of rows, wherein the first driving unit and the second driving unit, in one frame:sequentially supply the data voltage for an image display to the plurality of pixels of a first block including a first group of the plurality of rows; supply a black level voltage to the plurality of pixels of a second block including a second group of the plurality of rows; and supply the black level voltage to the plurality of pixels in at least one of the plurality of rows of the first block while the black level voltage is supplied to the plurality of pixels of the second block.

In another aspect, a display control device for controlling a display device including a display panel having a plurality of pixels arranged in a plurality of rows and a plurality of columns comprises: a first driving unit supplying a data voltage corresponding to a luminance to the plurality of pixels by the plurality of columns; and a second driving unit selecting the plurality of pixels receiving the data voltage by the plurality of rows, wherein the first driving unit and the second driving unit, in one frame: sequentially supply the data voltage for an image display to the plurality of pixels of a first block including a first group of the plurality of rows; supply a black level voltage to the plurality of pixels of a second block including a second group of the plurality of rows; and supply none of the data voltage and the black level voltage to the plurality of pixels in at least one of the plurality of rows of the first block.

In another aspect, a display control device for controlling a display device including a display panel having a plurality of pixels arranged in a plurality of rows and a plurality of columns comprises: a first driving unit supplying a data voltage corresponding to a luminance to the plurality of pixels by the plurality of columns; and a second driving unit selecting the plurality of pixels receiving the data voltage by the plurality of rows, wherein the first driving unit and the second driving unit, in one frame: sequentially supply the data voltage for an image display to the plurality of pixels of a first block including a first group of the plurality of rows; supply a black level voltage to the plurality of pixels of a second block including a second group of the plurality of rows; and supply the data voltage to the plurality of pixels in at least one of the plurality of rows of the first block, wherein the data voltage corresponding to the at least one of the plurality of rows is a same as the data voltage corresponding to another one of the plurality of rows.

In another aspect, a display device comprises: a display panel having a plurality of pixels arranged in a plurality of rows and a plurality of columns; and a display control device comprising: a first driving unit supplying a data voltage corresponding to a luminance to the plurality of pixels by the plurality of columns; and a second driving unit selecting the plurality of pixels receiving the data voltage by the plurality of rows, wherein the first driving unit and the second driving unit, in one frame: sequentially supply the data voltage for an image display to the plurality of pixels of a first block including a first group of the plurality of rows; supply a black level voltage to the plurality of pixels of a second block including a second group of the plurality of rows; and supply the data voltage to the plurality of pixels in at least one of the plurality of rows of the first block, wherein the data voltage corresponding to the at least one of the plurality of rows is a same as the data voltage corresponding to another one of the plurality of rows.

In another aspect, a method of controlling a display device including a display panel having a plurality of pixels arranged in a plurality of rows and a plurality of columns comprises: supplying a data voltage corresponding to a luminance to the plurality of pixels by the plurality of columns; and selecting the plurality of pixels receiving the data voltage by the plurality of rows, wherein the first driving unit and the second driving unit, in one frame: sequentially supply the data voltage for an image display to the plurality of pixels of a first block including a first group of the plurality of rows; supply a black level voltage to the plurality of pixels of a second block including a second group of the plurality of rows; and supply the black level voltage to the plurality of pixels in at least one of the plurality of rows of the first block while the black level voltage is supplied to the plurality of pixels of the second block.

In another aspect, a method of controlling a display device including a display panel having a plurality of pixels arranged in a plurality of rows and a plurality of columns comprises: supplying a data voltage corresponding to a luminance to the plurality of pixels by the plurality of columns; and selecting the plurality of pixels receiving the data voltage by the plurality of rows, wherein the first driving unit and the second driving unit, in one frame: sequentially supply the data voltage for an image display to the plurality of pixels of a first block including a first group of the plurality of rows; supply a black level voltage to the plurality of pixels of a second block including a second group of the plurality of rows; and supply none of the data voltage and the black level voltage to the plurality of pixels in at least one of the plurality of rows of the first block.

In another aspect, a method of controlling a display device including a display panel having a plurality of pixels arranged in a plurality of rows and a plurality of columns comprises: supplying a data voltage corresponding to a luminance to the plurality of pixels by the plurality of columns; and selecting the plurality of pixels receiving the data voltage by the plurality of rows, wherein the first driving unit and the second driving unit, in one frame: sequentially supply the data voltage for an image display to the plurality of pixels of a first block including a first group of the plurality of rows; supply a black level voltage to the plurality of pixels of a second block including a second group of the plurality of rows; and supply the data voltage to the plurality of pixels in at least one of the plurality of rows of the first block, wherein the data voltage corresponding to the at least one of the plurality of rows is a same as the data voltage corresponding to another one of the plurality of rows.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principles of the invention. In the drawings.

DETAILED DESCRIPTION

Figure 1:
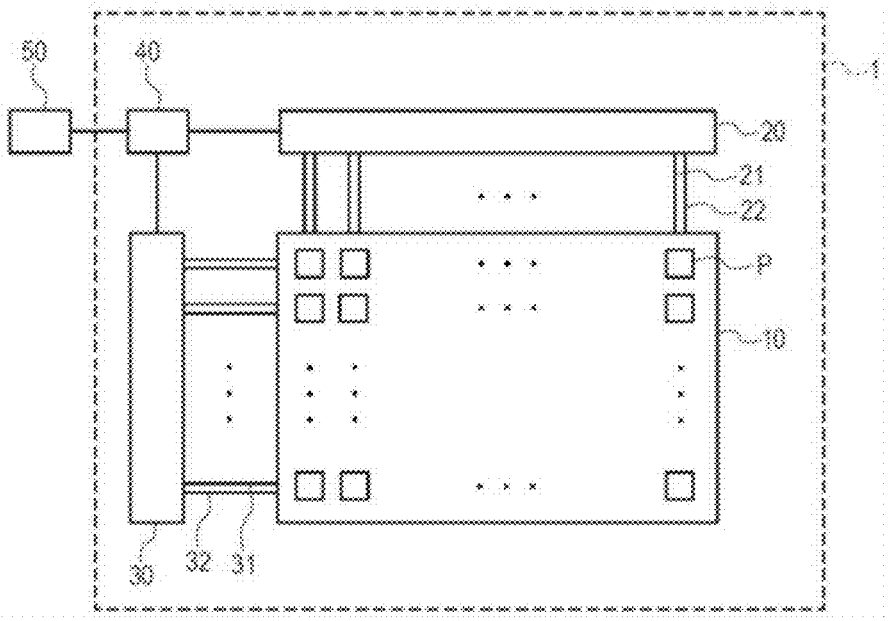
FIG. 1 is a view showing a display device according to a first embodiment of the present disclosure.

Reference will now be made in detail to embodiments of the present disclosure, examples of which may be illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments are provided so that this disclosure may be sufficiently thorough and complete to assist those skilled in the art to fully understand the scope of the present disclosure. Further, the present disclosure is only defined by scopes of claims.

Reference will now be made in detail to the present disclosure, examples of which are illustrated in the accompanying drawings.

FIG. 1 is a view showing a display device according to a first embodiment of the present disclosure. Although a display device 1 according to a first embodiment of the present disclosure may be exemplarily an image output device of a computer, a television, a smart phone, a game console, etc., the display device 1 is not limited thereto.

In FIG. 1, a display device 1 includes a display panel 10, a data driving circuit 20, a gate driving circuit 30 and a timing controller 40. The display device 1 displays an image in the display panel 10 based on an inputted RGB data, etc. The display panel 10 includes a plurality of pixels P disposed to constitute a plurality of rows and a plurality of columns. For example, the display device 1 may be an organic light emitting diode (OLED) display device using a light emitting diode as an emitting element of a pixel P. When the display device 1 displays a color image, the pixel P may be a sub-pixel displaying one of a plurality of colors (e.g., red, green and blue) constituting the color image.

A host system 50 supplies an image signal and a timing signal such as a vertical synchronization signal, a horizontal synchronization signal and a data enable signal to control the display device 1. For example, the host system 50 may include a television system, a set-top box, a navigation system, an optical disk player, a computer, a home theater system and a video phone system. In addition, the display device 1 and the host system 50 may be formed as one integrated apparatus or individual apparatuses.

The timing controller 40 controls the data driving circuit 20 and the gate driving circuit 30 based on the image signal and the timing signal inputted from the host system 50. The data driving circuit 20 supplies a data voltage and a reference voltage to a plurality of pixels P through a data line 21 and a reference line 22 disposed along a column of the plurality of pixels P. The gate driving circuit 30 supplies a control signal to the plurality of pixels P through a first gate line 31 and a second gate line 32 disposed along a row of the plurality of pixels P.

Each of the data driving circuit 20, the gate driving circuit 30 and the timing controller 40 may include at least one semiconductor integrated circuit. The data driving circuit 20, the gate driving circuit 30 and the timing controller 40 function as a display control device controlling the display device 1. The data driving circuit 20 functions as a first driving unit supplying the data voltage to the column of the plurality of pixels P. The gate driving circuit 30 functions as a second driving unit selecting the row of the plurality of pixels P receiving the data voltage.

Figure 2:
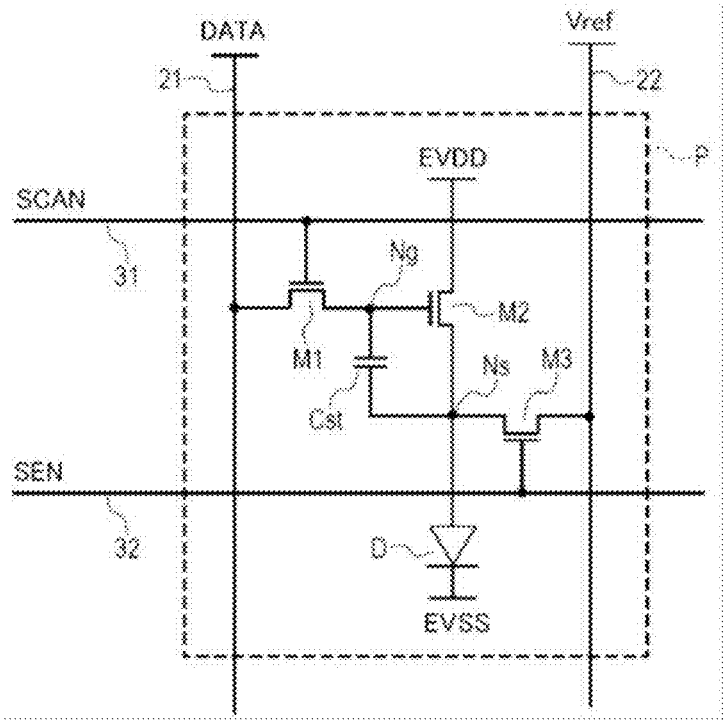
FIG. 2 is a circuit diagram showing a pixel of a display device according to a first embodiment of the present disclosure.

FIG. 2 is a circuit diagram showing a pixel of a display device according to a first embodiment of the present disclosure. Although a single pixel and lines connected to the single pixel are shown in FIG. 2, the other pixels have the same structure as the single pixel.

In FIG. 2, a pixel P includes a diode D, a storage capacitor Cst, a scan transistor M1, a driving transistor M2 and a sense transistor M3. The diode D as an emission element of the display device 1 may include a light emitting diode. The scan transistor M1, the driving transistor M2 and the sense transistor M3 may have a negative (n) channel type. However, the scan transistor M1, the driving transistor M2 and the sense transistor M3 may have a positive (p) channel type in another embodiment. When the driving transistor M2 has a p-channel type, the circuit structure of the pixel P may be different from that of FIG. 2. Although the scan transistor M1 and the sense transistor M3 includes a source and a drain as a main electrode, the source and the drain may be inverted according to a direction of a current flow. For example, the source and the drain of the scan transistor M1 and the sense transistor M3 may be described as a first main electrode and a second main electrode hereinafter.

A cathode of the diode D is connected to a line supplying a low level voltage EVSS, and an anode of the diode D is connected to the source of the driving transistor M2, the first main electrode of the sense transistor M3 and a first electrode of the storage capacitor Cst. The drain of the driving transistor M2 is connected to a line supplying a high level voltage EVDD. The gate of the driving transistor M2 is connected to the first main electrode of the scan transistor M1 and a second electrode of the storage capacitor Cst. The gate of the driving transistor M2, the first main electrode of the scan transistor M1 and the second electrode of the storage capacitor Cst are connected to each other at a first node Ng. The anode of the diode D, the source of the driving transistor M2, the first main electrode of the sense transistor M3 and the first electrode of the storage capacitor Cst are connected to each other at a second node Ns.

The second main electrode of the scan transistor M1 is connected to the data line 21. The data driving circuit 20 supplies the data voltage DATA to the second main electrode of the scan transistor M1 through the data line 21. The gate of the scan transistor M1 is connected to the gate line 31. The gate driving circuit 30 supplies the scan signal SCAN to the gate of the scan transistor M1 through the gate line 31. The scan transistor M1 is controlled to have an ON state or an OFF state according to a level of the scan signal SCAN inputted to the gate.

The second main electrode of the sense transistor M3 is connected to the reference line 22. The data driving circuit 20 supplies a reference voltage Vref to the second main electrode of the sense transistor M3 through the reference line 22. The gate of the sense transistor M3 is connected to the second gate line 32. The gate driving circuit 30 supplies a sensing signal SEN to the gate of the sense transistor M3 through the second gate line 32. The sense transistor M3 is controlled to have an ON state or an OFF state according to a level of the sensing signal SEN inputted to the gate.

Figure 3:
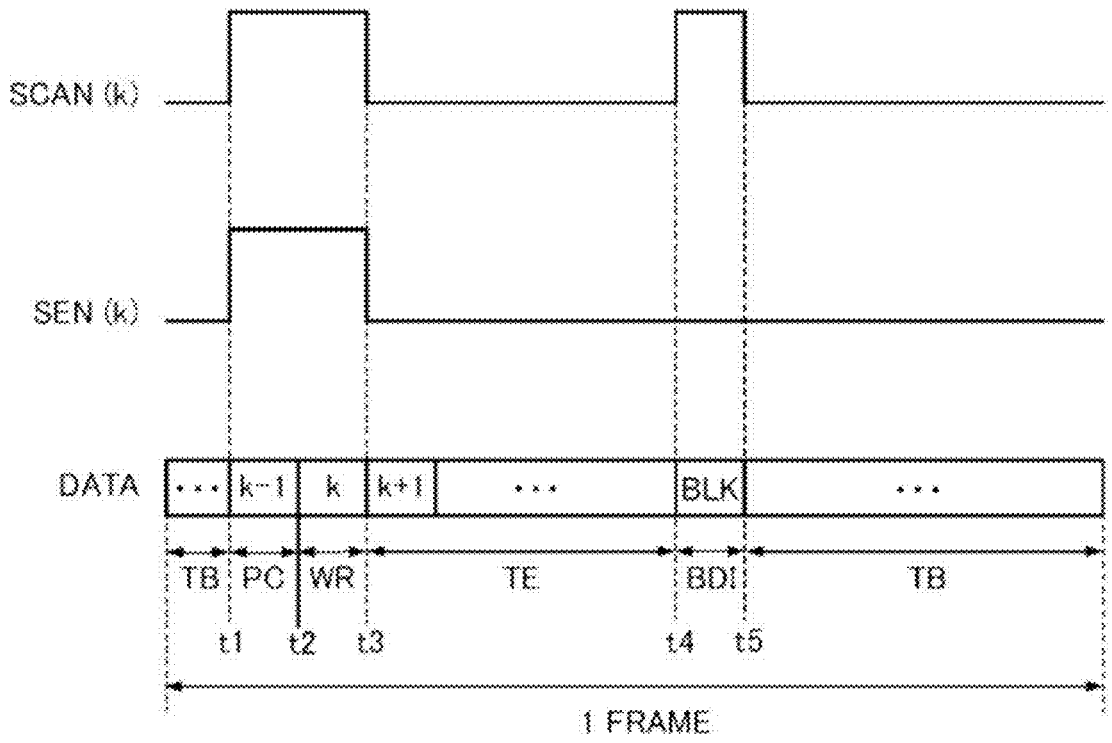
FIG. 3 is a timing chart showing a driving method for one row of a display device according to a first embodiment of the present disclosure.

FIG. 3 is a timing chart showing a driving method for one row of a display device according to a first embodiment of the present disclosure. In FIG. 3, a single frame of the scan signal SCAN(k) and the sensing signal SEN(k) supplied to the pixel P in the kth row of the display panel 10 and the data voltage DATA supplied to the pixels P in the column are shown.

The character 'k' of the scan signal SCAN(k) and the sensing signal SEN(k) represents a row number. When the scan signal SCAN(k) and the sensing signal SEN(k) have a high level, the corresponding transistors are turned on. When the scan signal SCAN(k) and the sensing signal SEN(k) have a low level, the corresponding transistors are turned off.

The characters 'k−1,' 'k' and 'k+1' assigned to the data voltage DATA represent that the data voltage for an image display corresponding to a luminance of each pixel P in the corresponding row of the column is outputted from the data driving circuit 20. The character 'BLK' assigned to the data voltage DATA represents that a voltage (a black level voltage) is outputted from the data driving circuit 20. The black level voltage controls the driving transistor M2 such that the light emitting diode D is turned off and the luminance becomes 0. The character '1 FRAME' represents a period of one frame.

At a first timing t1, the scan signal SCAN(k) and the sensing signal SEN(k) have a high level, and the scan transistor M1 and the sense transistor M3 are turned on. The data voltage DATA at the first timing t1 corresponds to the (k−1)th row. The first node Ng has a voltage corresponding to the data voltage of the (k−1)th row, and the second node Ns has a voltage corresponding to the reference voltage Vref. As a result, the data voltage corresponding to the (k−1)th row is stored between two electrodes of the storage capacitor Cst.

At a second timing t2, the data voltage DATA is changed to a voltage corresponding to the (k)th row, and the voltage of the first node Ng is changed to a voltage corresponding to the data voltage of the (k)th row. As a result, the data voltage corresponding to the (k)th row is stored between two electrodes of the storage capacitor Cst.

At a third timing t3, the scan signal SCAN(k) and the sensing signal SEN(k) have a low level, and the scan transistor M1 and the sense transistor M3 are turned off. As a result, the data voltage corresponding to the (k−1)th row is maintained between two electrodes of the storage capacitor Cst.

A period between the first and second timings t1 and t2 is a pre-charging time period PC, and a period between the second and third timings t2 and t3 is a writing time period WR. During the writing time period WR, the data voltage of the (k)th row is maintained in the storage capacitor Cst. During the pre-charging time period PC, the storage capacitor Cst is previously charged by applying the data voltage of the previous row to the storage capacitor Cst before the writing time period WR. While a voltage is maintained in the storage capacitor Cst, an excellent accuracy of the voltage may not be obtained due to an insufficient time for moving a charge. In the first embodiment, since the pre-charging time period PC is set before the writing time period WR, the accuracy of the voltage in the storage capacitor Cst is improved.

A period between the third and fourth timings t3 and t4 is an emitting time period TE where the light emitting diode D emits a light with a luminance according to the data voltage maintained in the storage capacitor Cst. During the emitting time period TE, the data voltage maintained in the storage capacitor Cst is applied between the gate and the source of the driving transistor M2. As a result, a driving current flows through the light emitting diode D, and the light emitting diode D emits the light with the luminance according to the data voltage maintained in the storage capacitor Cst.

At a fourth timing t4, the scan signal SCAN(k) has a high level, and the scan transistor M1 is turned on. The data voltage DATA at the fourth timing t4 corresponds to the black level voltage. The first node Ng has a voltage corresponding to the black level voltage, and the driving transistor M2 is turned off.

At a fifth timing t5, the scan signal SCAN(k) has a low level, and the scan transistor M1 is turned off. As a result, the black level voltage is maintained between two electrodes of the storage capacitor Cst. A period between the fourth and fifth timings t4 and t5 is a black data inserting time period BDI where the black level voltage is maintained in the storage capacitor Cst.

A period after the fifth timing t5 is a non-emitting time period TB where the light emitting diode D emits a light with a luminance according to the data voltage maintained in the storage capacitor Cst. During the non-emitting time period TB, the black level voltage maintained in the storage capacitor Cst is applied between the gate and the source of the driving transistor M2. As a result, the driving current does not flow through the light emitting diode D, and the light emitting diode D has a non-emitting state. The non-emitting state is maintained till the first timing t1 of the next frame.

In the first embodiment, the single frame includes the emitting time period TE and the non-emitting time period TB. The light emitting diode D performs an on-and-off operation where an emission and a non-emission are repeated. Since the single frame includes the non-emitting time period TB, a motion picture response time (MPRT) is reduced and a display quality of a moving image is improved. An emission duty ratio in the on-and-off operation is substantially the same as a ratio of the emitting time period TE with respect to the single frame.

Figure 4:
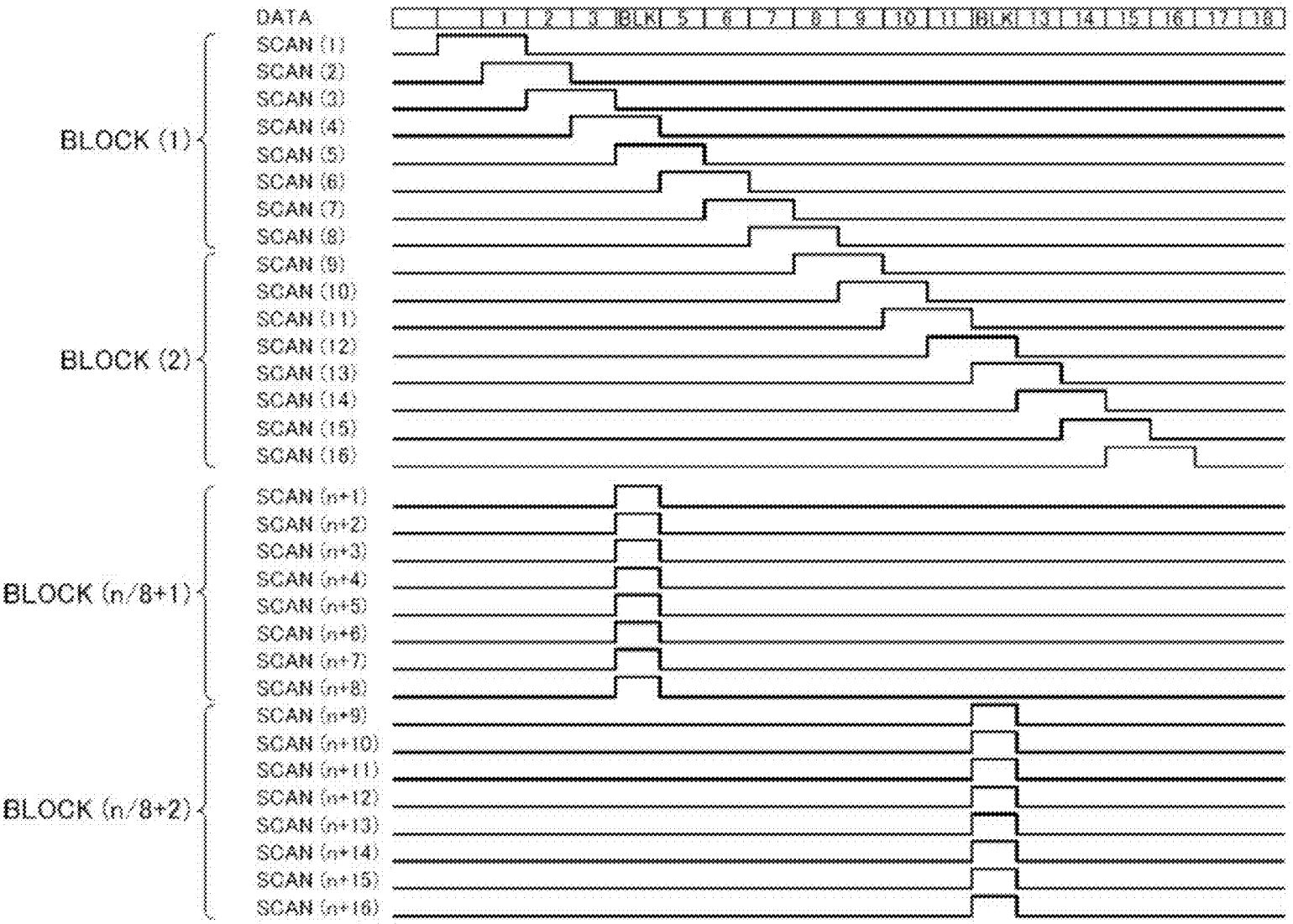
FIG. 4 is a timing chart showing a driving method for blocks of a display device according to a first embodiment of the present disclosure.

FIG. 4 is a timing chart showing a driving method for blocks of a display device according to a first embodiment of the present disclosure. A driving method of each row of the display device 1 will be illustrated with reference to FIG. 4. In FIG. 4, the scan signals SCAN(1) to SCAN(16) of 20 horizontal periods supplied to the pixels of first row to sixteenth row and the scan signals SCAN(n+1) to SCAN (n+16) of 20 horizontal periods supplied to the pixels of the (n+1)th row to the (n+16)th row are shown.

Since the same operation is repeated by 8 rows in the driving method of the first embodiment, a pixel group of pixels in 8 rows such as the first row to the eighth row and the ninth row to the sixteenth row is defined as a block BLOCK. In FIG. 4, a first block BLOCK(1) may correspond to the first row to the eighth row, a second block BLOCK(2) may correspond to the ninth row to the sixteenth row, a (n/8+1)th block BLOCK(n/8+1) may correspond to the (n+1)th row to the (n+8)th row, and a (n/8+2)th block BLOCK(n/8+2) may correspond to the (n+9)th row to the (n+16)th row.

For example, the scan signal SCAN(2) of the first block BLOCK(1) has a high level during a period where the data voltage of the first row is inputted and during a period where the data voltage of the second row is inputted. As a result, the period where the data voltage is inputted to the pixel P in the first row corresponds to the pre-charging time period PC of the pixel P in the second row, and the period where the data voltage is inputted to the pixel P in the second row corresponds to the writing time period WR of the pixel P in the second row.

The scan signal SCAN(3) of the first block BLOCK(1) has a high level during a period delayed by one horizontal period from the scan signal SCAN(2). In the first block BLOCK(1), the scan signals SCAN(1) to SCAN(8) sequentially have the high level delayed by one horizontal period, and the data voltage is sequentially written to the pixel P of the rows.

During a section between the period where the data voltage is inputted to the pixel P in the third row and the period where the data voltage is inputted to the pixel P in the fifth row, the black level voltage is inputted to the pixel P in the fourth row instead of the data voltage for the fourth row. During the section, the scan signals SCAN(n+1) to SCAN (n+8) of the (n/8+1)th block BLOCK(n/8+1) have a high level. As a result, the section corresponds to the black data inserting time period BDI.

The scan signal SCAN(4) for the pixel P in the fourth row has a high level during the section where the black level voltage BLK is inputted and the section corresponds to the writing time period WR for the pixel P in the fourth row. As a result, the black level voltage is maintained in two electrodes of the storage capacitor Cst of the pixel P in the fourth row instead of the data voltage for the fourth row.

Accordingly, the corresponding data voltage is written in the pixel P of the first row to the third row and the fifth row to the eighth row, and the black level voltage is written in the pixel P of the fourth row. Similarly, in the second block BLOCK(2), the corresponding data voltage is written in the pixel P of the ninth row to the eleventh row and the thirteenth row to the sixteenth row, and the black level voltage is written in the pixel P of the twelfth row. The black data inserting time period BDI of a block (e.g., BLOCK(n/8+1)) overlaps the writing time period WR of the data voltage for an image display of another block (e.g., BLOCK (1)). As a result, writing of the data voltage for an image display is not performed and the black level voltage is maintained in the pixel P of the corresponding row.

Figure 5:
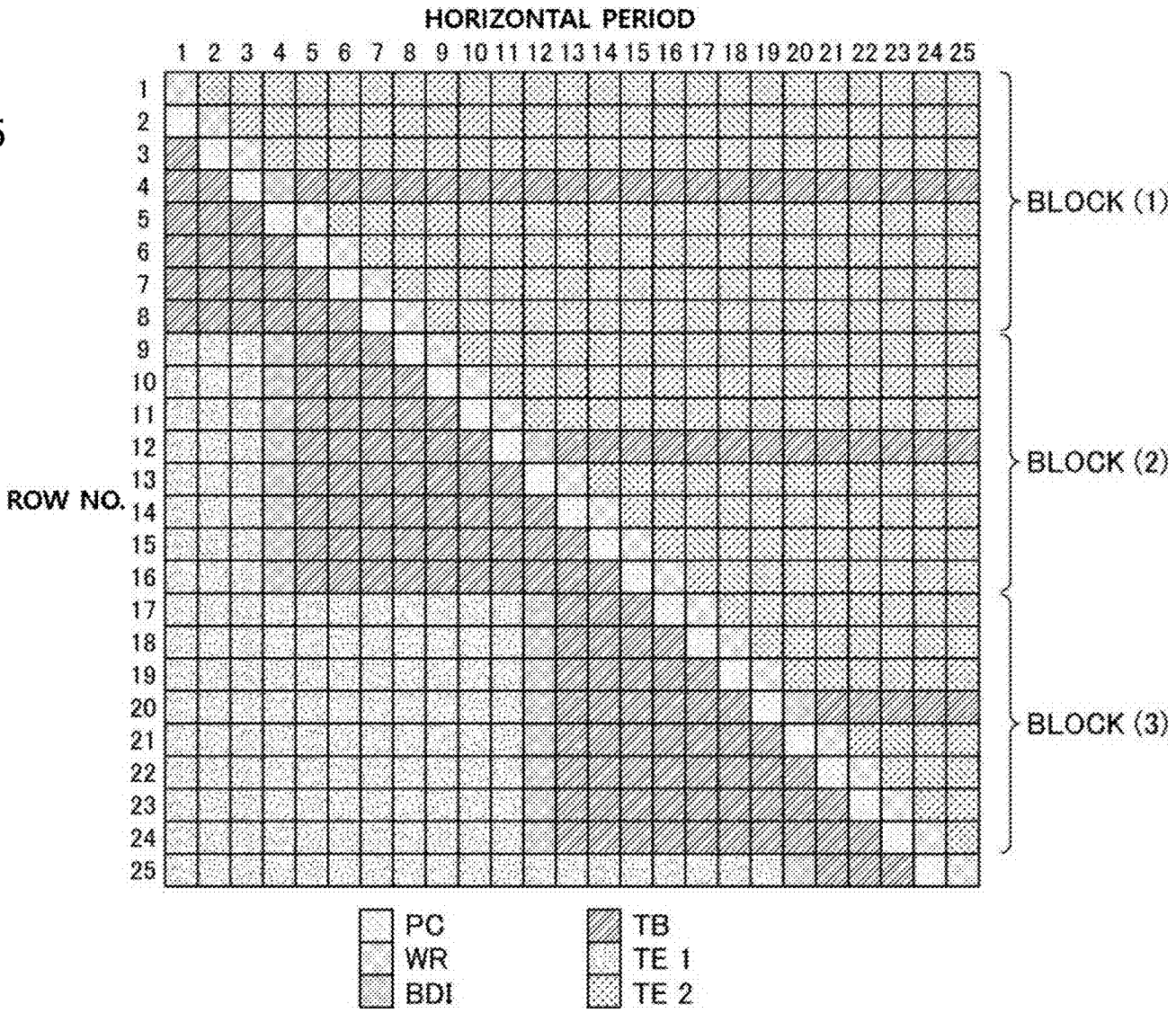
FIG. 5 is a view showing a display process in rows of a display device according to a first embodiment of the present disclosure.

FIG. 5 is a view showing a display process in rows of a display device according to a first embodiment of the present disclosure. A vertical axis of FIG. 5 corresponds to a row number and a horizontal axis of FIG. 5 corresponds to a number of a horizontal period. The row number represents a position of the display panel 10 along a vertical direction and the number of the horizontal period represents a passage of time.

For convenience of showing, in FIG. 5, the second block where the black level voltage is supplied is a next block of the first block where the data voltage is sequentially supplied. In FIG. 5, the display device 1 is driven according to the timing chart of FIG. 4 when n is 8.

A pattern in each of boxes arranged in matrix represents a state of each pixel P. The state of the pattern is classified as legends shown under FIG. 5. The legend 'PC' represents a state where the pixel P of the corresponding row number has the pre-charging time period PC. The legend 'WR' represents a state where the pixel P of the corresponding row number has the writing time period WR. The legend 'BDI' represents a state where the pixel P of the corresponding row number has the black data inserting time period BDI. The legend 'TB' represents a state where the pixel P of the corresponding row number has the non-emitting time period TB. The legend 'TE1' represents a state where the pixel P of the corresponding row number has the emitting time period TE of a present frame, and the legend 'TE2' represents a state where the pixel P of the corresponding row number has the emitting time period TE of a next frame.

In the horizontal period of 4, writing of the black level voltage is performed in the pixels P of the ninth row to the sixteenth row of the second block BLOCK(2) and in the pixel P of the fourth row of the first block BLOCK(1). The data voltage corresponding to each row is written in the pixels P of the first row to the third row and the fifth row to the eighth row of the first block BLOCK(1). As a result, the pixels P of the first row to the third row and the fifth row to the eighth row of the first block BLOCK(1) emit a light according to the data voltage, and the pixel P of the fourth row of the first block BLOCK(1) has the non-emitting state where a light is not emitted. Accordingly, a dark line is generated in the fourth row of the display panel 10. The dark line of one row is generated in each block. However, since the image according to the data voltage is displayed in most of rows, the dark line is rarely recognized in a moving image display. Therefore, the black data may be inserted according to the driving method of the first embodiment.

Figure 6:
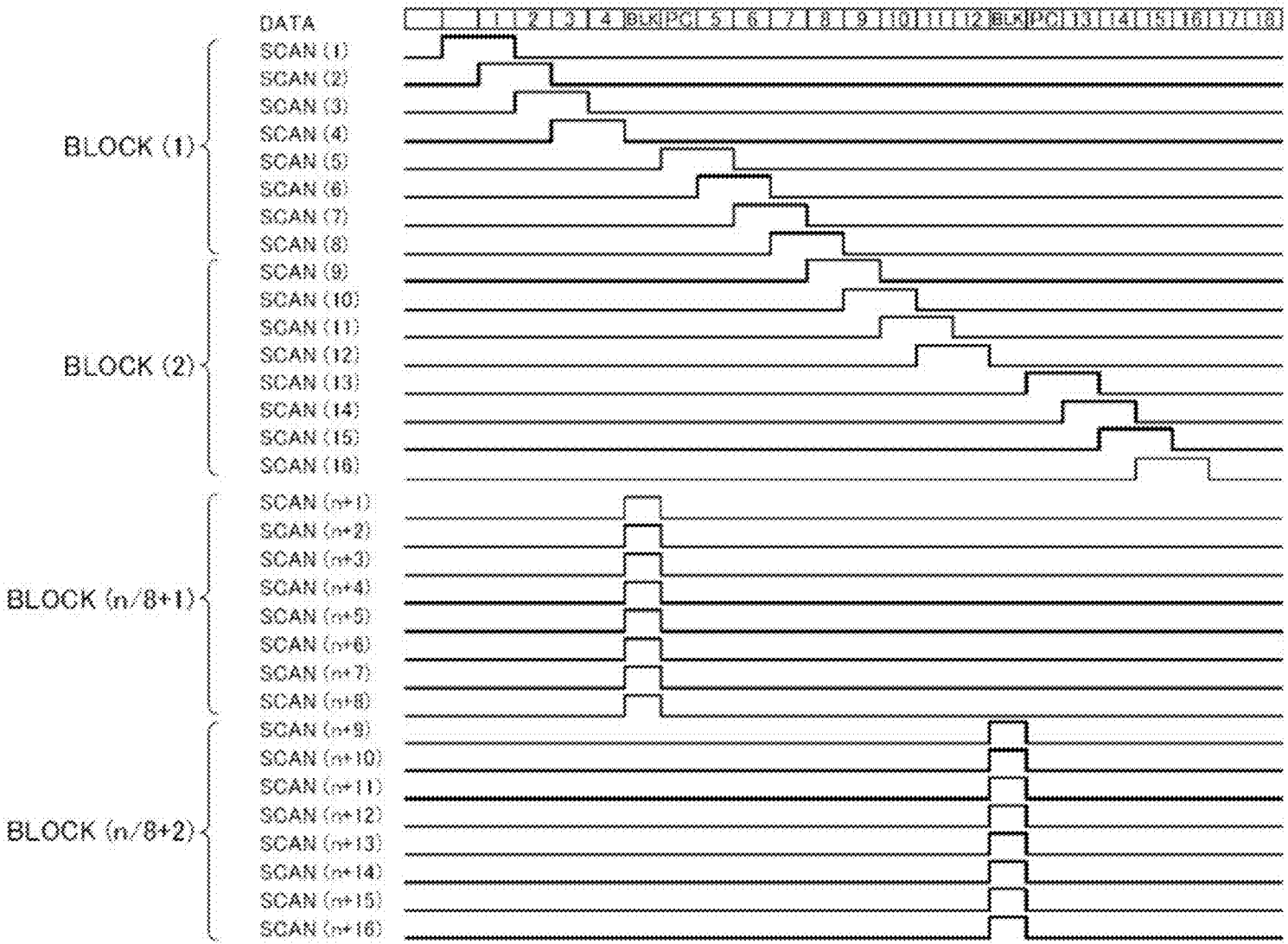
FIG. 6 is a timing chart showing a driving method for blocks of a display device according to a comparison example.

A comparison example will be illustrated hereinafter for the effect of the first embodiment. FIG. 6 is a timing chart showing a driving method for blocks of a display device according to a comparison example. In the driving method of the first embodiment of FIG. 4, the period where the fourth scan signal SCAN(4) for the pixel P in the fourth row has a high level overlaps the period where the black level voltage is inputted when the scan signal of the first block BLOCK(1) sequentially has a high level. In the comparison example, the fourth scan signal SCAN(4) for the pixel P in the fourth row has a high level and writing of the data voltage is performed in the pixel P of the fourth row. After writing of the data voltage in the pixel P of the fourth row is completed, writing of the black level voltage of the (n/8+1)th block BLOCK(n/8+1) is performed during the black data inserting time period BDI. Next, the fifth scan signal SCAN(5) has a high level and writing of the data voltage is performed in the pixel P of the fifth row. In the driving method of the comparison example, the period where each of the first to eighth scan signals SCAN(1) to SCAN(8) of the first block BLOCK(1) for the pixel P of each row has a high level does not overlap the black data inserting time period BDI.

Figure 7:
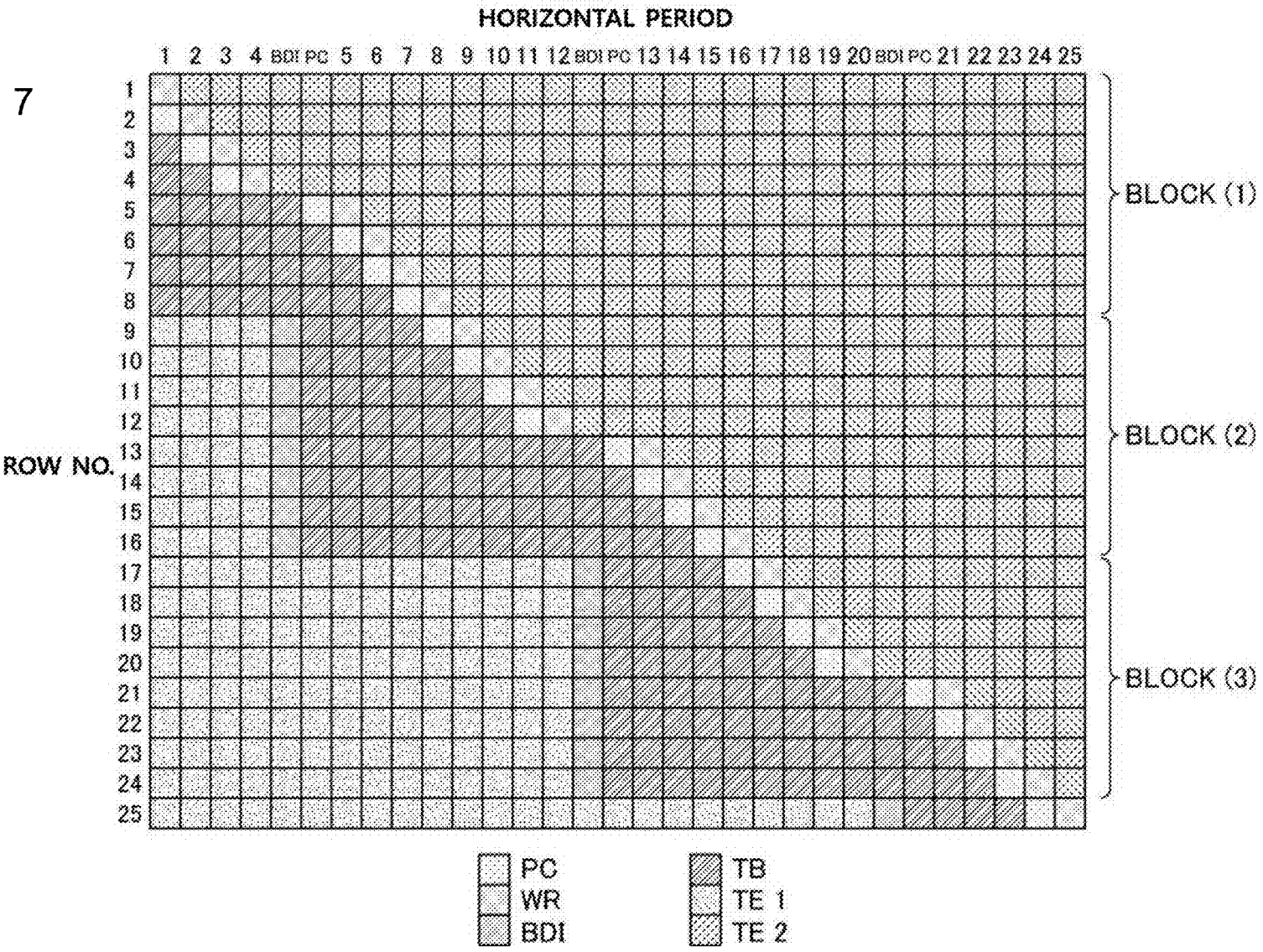
FIG. 7 is a view showing a display process in rows of a display device according to a comparison example.

FIG. 7 is a view showing a display process in rows of a display device according to a comparison example. In FIG. 7, the period where each of the first to eighth scan signals SCAN(1) to SCAN(8) for each row of the first block BLOCK(1) has a high level does not overlap the black data inserting time period BDI. Since the data voltage is written in the pixel P of all rows, the dark line is not generated.

However, in the driving method of the comparison example, since the black data inserting time period BDI and the pre-charging time period PC as well as the period for 8 rows are required for writing of the data voltage in the pixels P of 8 rows of the first block BLOCK(1), a time corresponding to 10 horizontal periods is required for writing of the data voltage. Since a length of one frame is determined according to a specification of the display device 1, reduction of one horizontal period is required for the driving method of the comparison example. As a result, a time for writing of the data voltage for one row is shortened. For example, in the driving method of the comparison example, a time for writing of the data voltage may become $8/10=0.8$ times. Accordingly, a time for writing of the data voltage is not sufficiently obtained and a display quality is deteriorated. Specifically, in a high resolution display device having a relatively high number of rows, since a time for writing the data voltage is further shortened, the display quality may be further deteriorated.

In the first embodiment, since the black data inserting time period BDI of the (n/8+1)th block BLOCK(n/8+1) overlaps the period where one scan signal of the first block BLOCK(1) has a high level, addition of the black data inserting time period BDI and the pre-charging time period PC is not required in the first block BLOCK(1). As a result, the writing time of the data voltage of the first embodiment is elongated as compared with that of the comparison example. Accordingly, in the first embodiment, the display quality of a moving image is improved due to insertion of the black image and the sufficient writing time of the data voltage for image display is obtained.

A display device driven by a driving method according to a second embodiment where a sufficient writing time is obtained will be illustrated hereinafter. Since the structure of the display device of the second embodiment is the same as that of the display device of the first embodiment, illustration on the structure is omitted.

Figure 8:
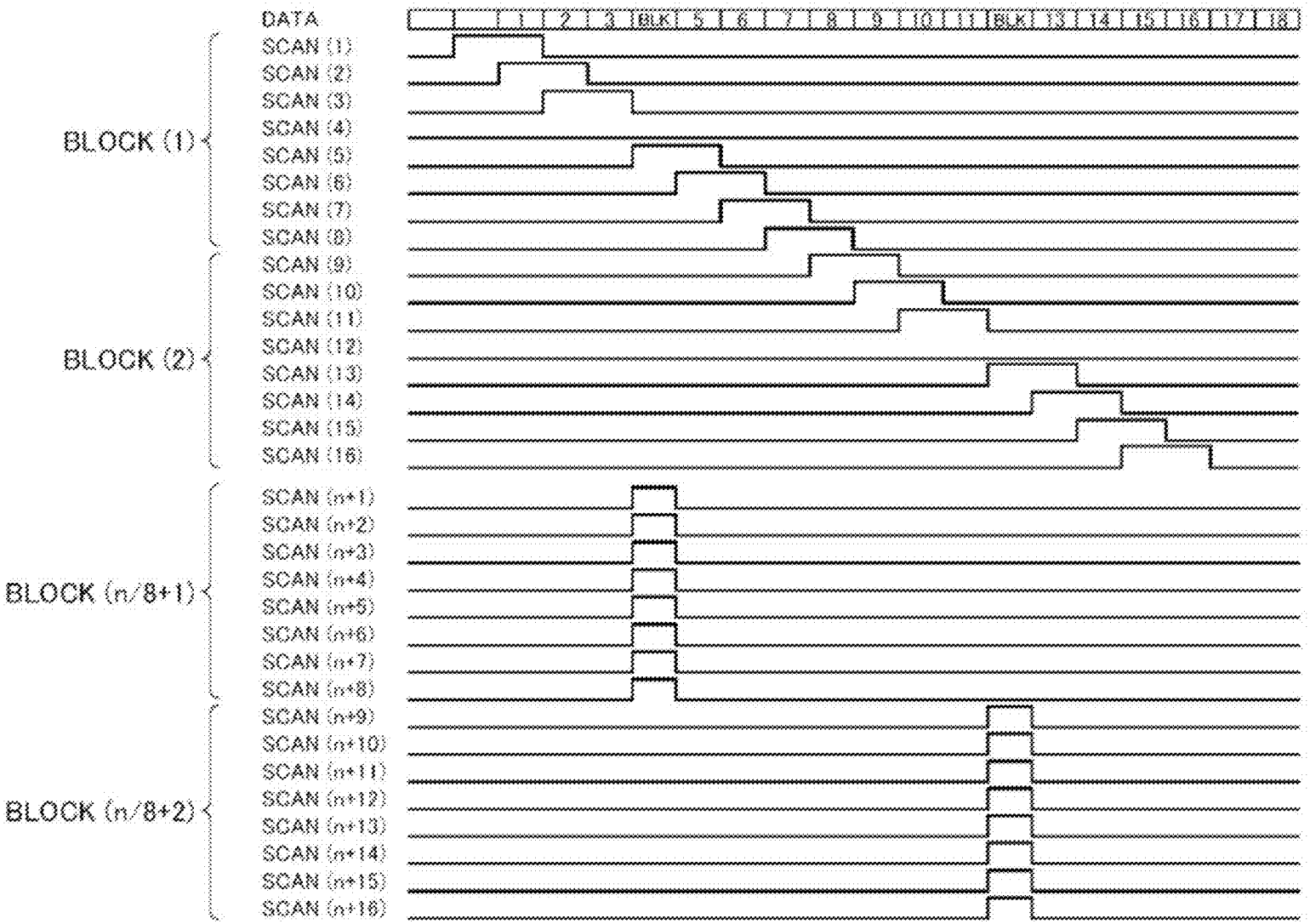
FIG. 8 is a timing chart showing a driving method for blocks of a display device according to a second embodiment of the present disclosure.

FIG. 8 is a timing chart showing a driving method for blocks of a display device according to a second embodiment of the present disclosure. In the driving method of the first embodiment of FIG. 4, the period where the fourth scan signal SCAN(4) for the pixel P in the fourth row has a high level overlaps the period where the black level voltage is inputted when the scan signal of the first block BLOCK(1) sequentially has a high level. In the driving method of the second embodiment, the fourth scan signal SCAN(4) for the pixel P in the fourth row does not have a high level. Since a scan is omitted, the data voltage is not written during the period where the black level voltage is inputted.

Figure 9:
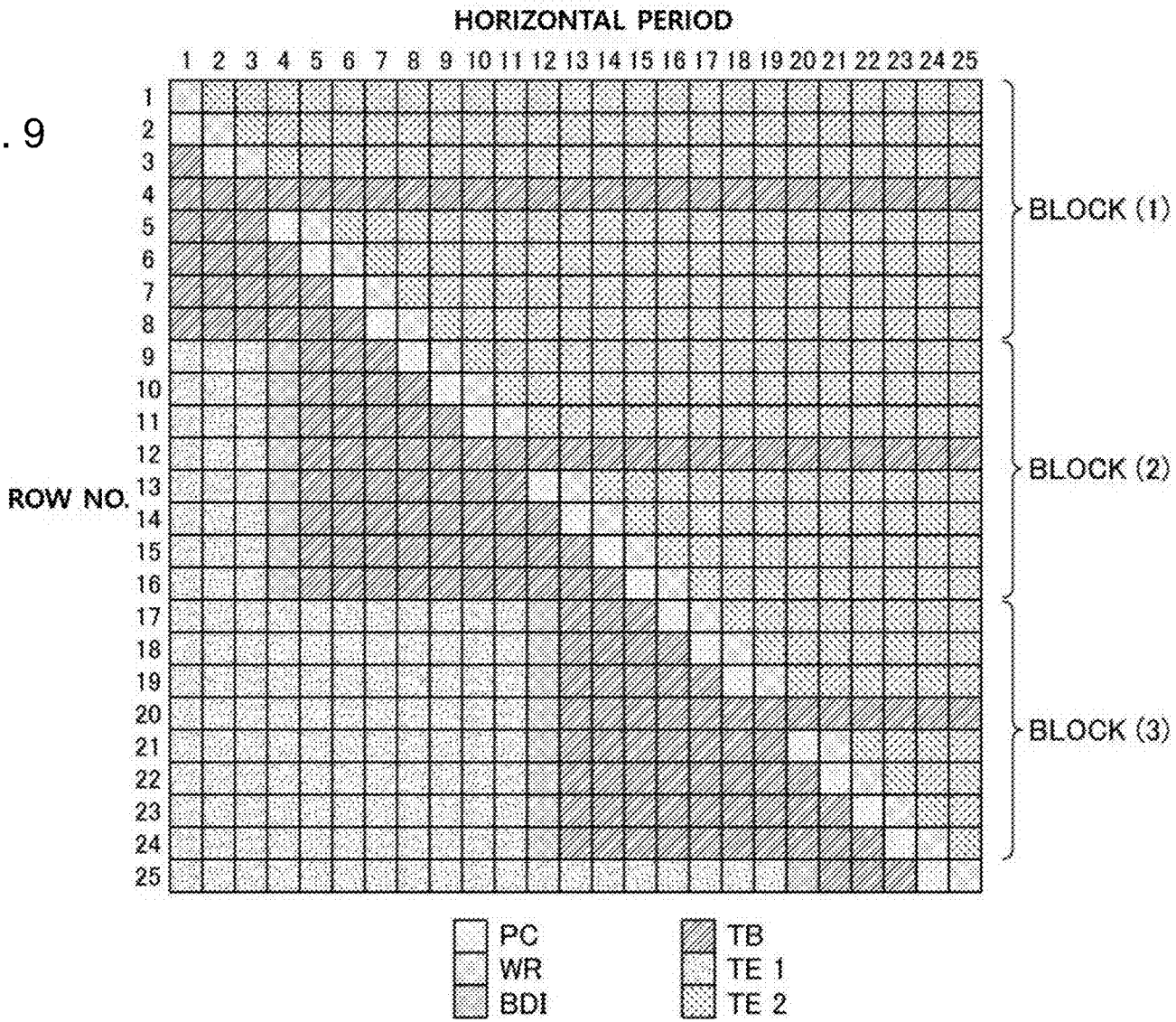
FIG. 9 is a view showing a display process in rows of a display device according to a second embodiment of the present disclosure.

FIG. 9 is a view showing a display process in rows of a display device according to a second embodiment of the present disclosure. In the horizontal period of 4, writing of the black level voltage is performed in the pixels P of the ninth row to the sixteenth row of the second block BLOCK (2) and writing of the data voltage and the black level voltage is not performed in the pixel P of the fourth row of the first block BLOCK(1). The black level voltage written during a previous black data inserting time period BDI is maintained in the pixel P of the fourth row of the first block BLOCK(1), and the pixel P of the fourth row of the first block BLOCK(1) has the non-emitting state. As a result, a dark line is generated in the fourth row of the display panel 10. The dark line of one row is generated in each block. However, since the image according to the data voltage is displayed in most of rows, the dark line is rarely recognized in a moving image display. Therefore, the black data may be inserted according to the driving method of the second embodiment.

In the second embodiment, the display quality of a moving image is improved due to insertion of the black image and the sufficient writing time of the data voltage for image display is obtained. An advantage of the first and second embodiments as compared with the third and fourth embodiments is a simple processing.

A display device driven by a driving method according to a third embodiment where a sufficient writing time is obtained will be illustrated hereinafter. Since the structure of the display device of the third embodiment is the same as that of the display device of the first embodiment, illustration on the structure is omitted.

Figure 10:
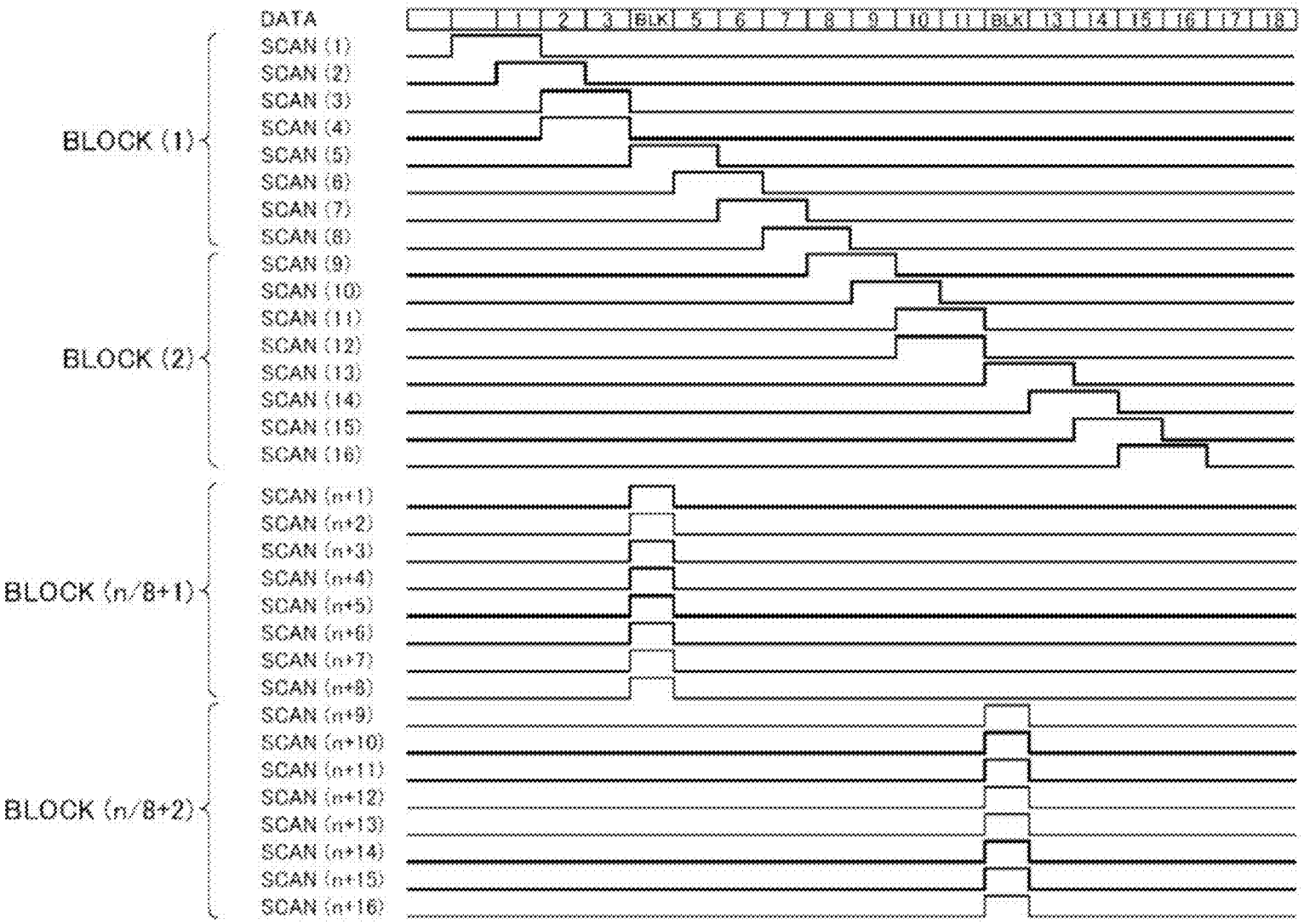
FIG. 10 is a timing chart showing a driving method for blocks of a display device according to a third embodiment of the present disclosure.

FIG. 10 is a timing chart showing a driving method for blocks of a display device according to a third embodiment of the present disclosure. In the driving method of the first embodiment of FIG. 4, the period where the fourth scan signal SCAN(4) for the pixel P in the fourth row has a high level overlaps the period where the black level voltage is inputted when the scan signal of the first block BLOCK(1) sequentially has a high level. In the driving method of the third embodiment, the fourth scan signal SCAN(4) for the pixel P in the fourth row has a high level one horizontal period earlier. Since the fourth scan signal SCAN(4) for the pixel P in the fourth row has a high level at the same time with the third scan signal SCAN(3) for the pixel P in the third row, the data voltage is not written during the period where the black level voltage is inputted.

Figure 11:
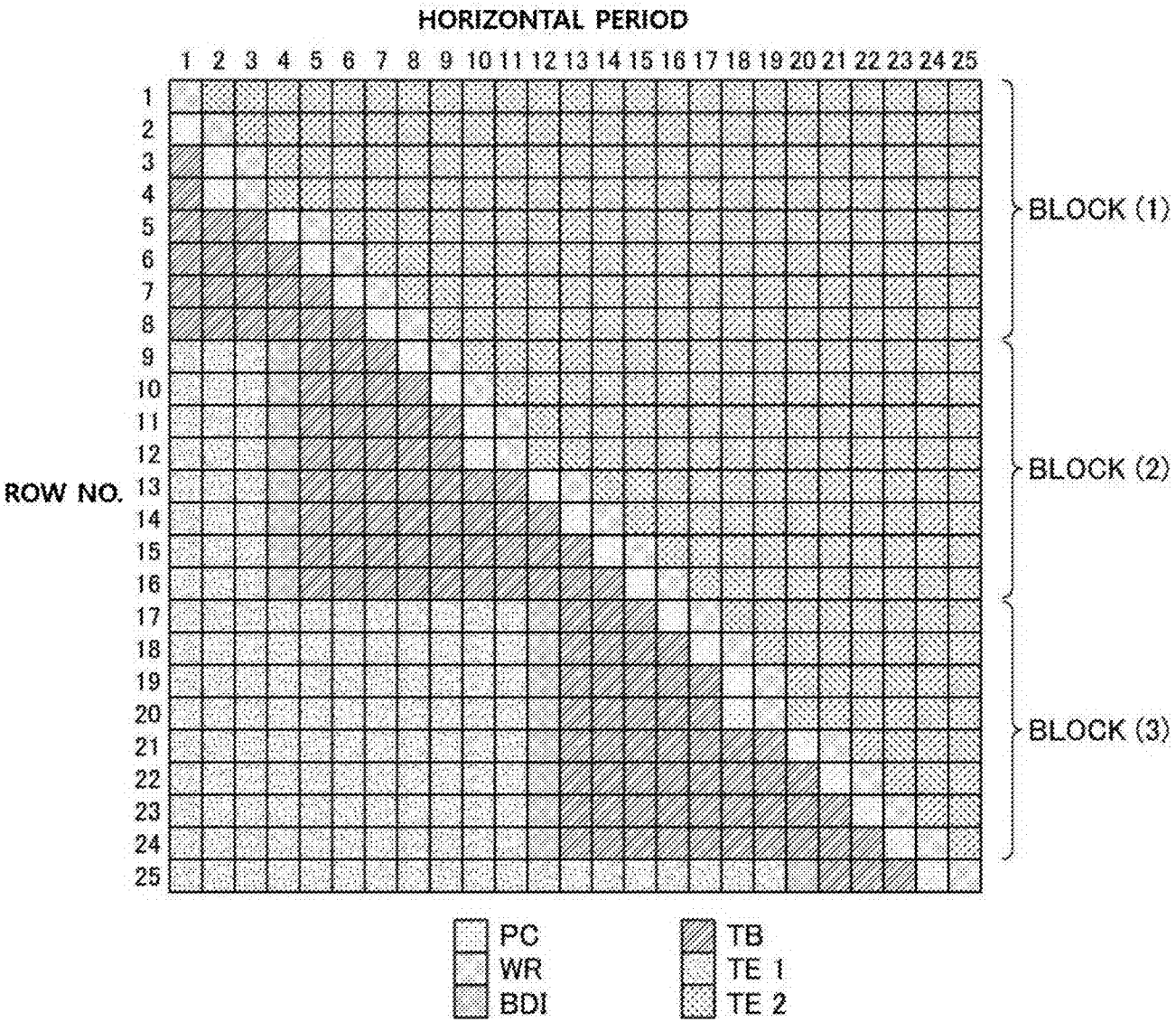
FIG. 11 is a view showing a display process in rows of a display device according to a third embodiment of the present disclosure.

FIG. 11 is a view showing a display process in rows of a display device according to a third embodiment of the present disclosure. In the horizontal period of 3, writing of the data voltage is performed in the pixels P of the third row and the fourth row of the first block BLOCK(1). In the horizontal period of 4, the black level voltage is performed in the pixels P of the ninth row to the sixteenth row of the second block BLOCK(2) and writing of the data voltage is not performed in the pixel P of the fourth row of the first block BLOCK(1). The pixel P of the fourth row of the first block BLOCK(1) emits a light of a luminance according to the data voltage for the third row. As a result, the same luminance is displayed in the third row and the fourth row of the display panel 10. Similarly, two rows among eight rows displays the same luminance in another block. Although an image different from an original image is displayed, the image according to the data voltage is displayed in most of rows. Accordingly, the two rows having the same luminance is rarely recognized. Therefore, the black data may be inserted according to the driving method of the third embodiment.

In the third embodiment, the display quality of a moving image is improved due to insertion of the black image and the sufficient writing time of the data voltage for image display is obtained. In addition, since a dark line of the first and second embodiments is not displayed, a display quality is further improved and reduction in luminance due to the dark line is prevented.

A display device driven by a driving method according to a fourth embodiment where a sufficient writing time is obtained will be illustrated hereinafter. Since the structure of the display device of the fourth embodiment is the same as that of the display device of the first embodiment, illustration on the structure is omitted.

Figure 12:
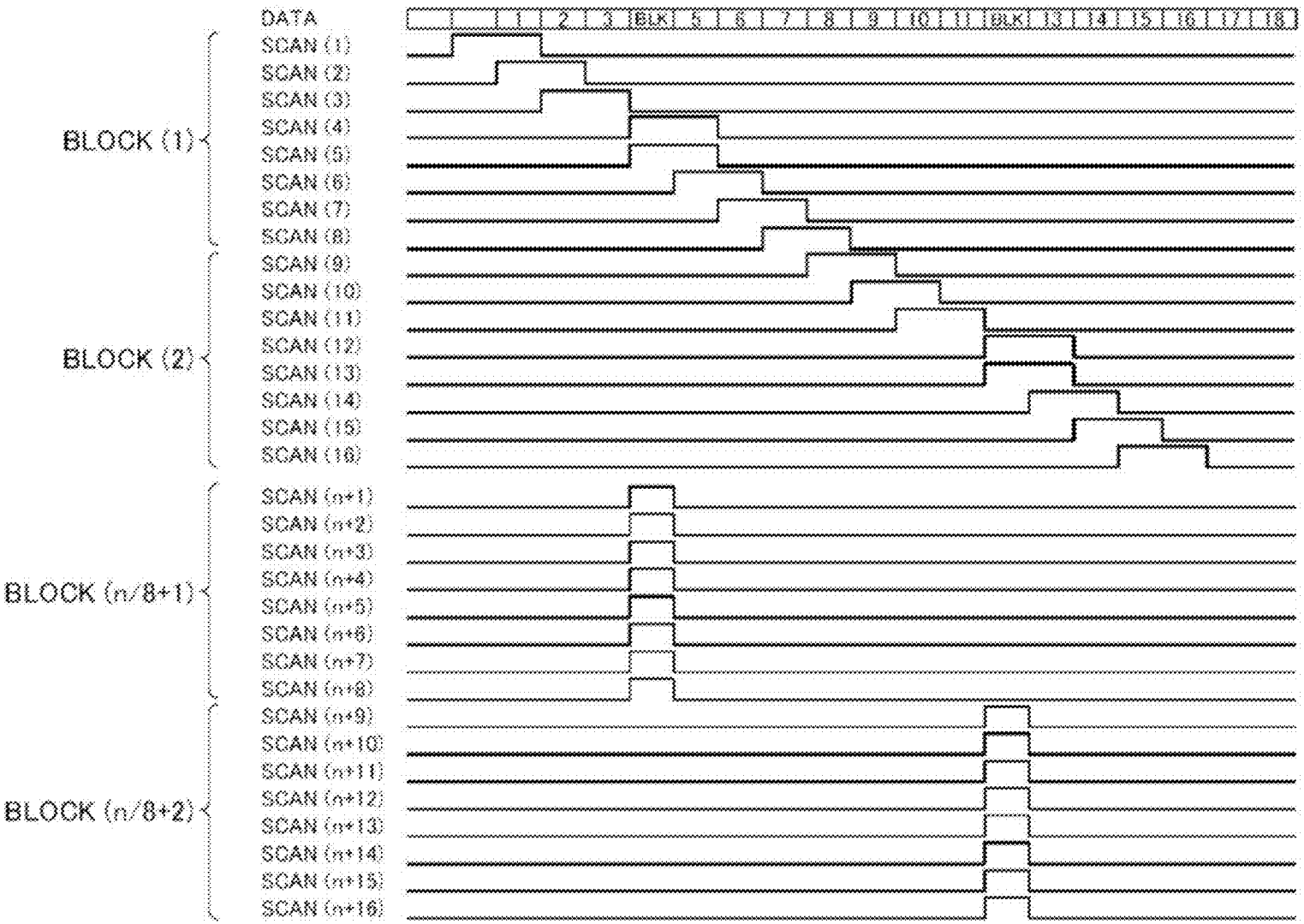
FIG. 12 is a timing chart showing a driving method for blocks of a display device according to a fourth embodiment of the present disclosure.

FIG. 12 is a timing chart showing a driving method for blocks of a display device according to a fourth embodiment of the present disclosure. In the driving method of the first embodiment of FIG. 4, the period where the fourth scan signal SCAN(4) for the pixel P in the fourth row has a high level overlaps the period where the black level voltage is inputted when the scan signal of the first block BLOCK(1) sequentially has a high level. In the driving method of the fourth embodiment, the fourth scan signal SCAN(4) for the pixel P in the fourth row has a high level one horizontal period later. Since the fourth scan signal SCAN(4) for the pixel P in the fourth row has a high level at the same time with the fifth scan signal SCAN(5) for the pixel P in the fifth row, the data voltage is not written during the period where the black level voltage is inputted.

Figure 13:
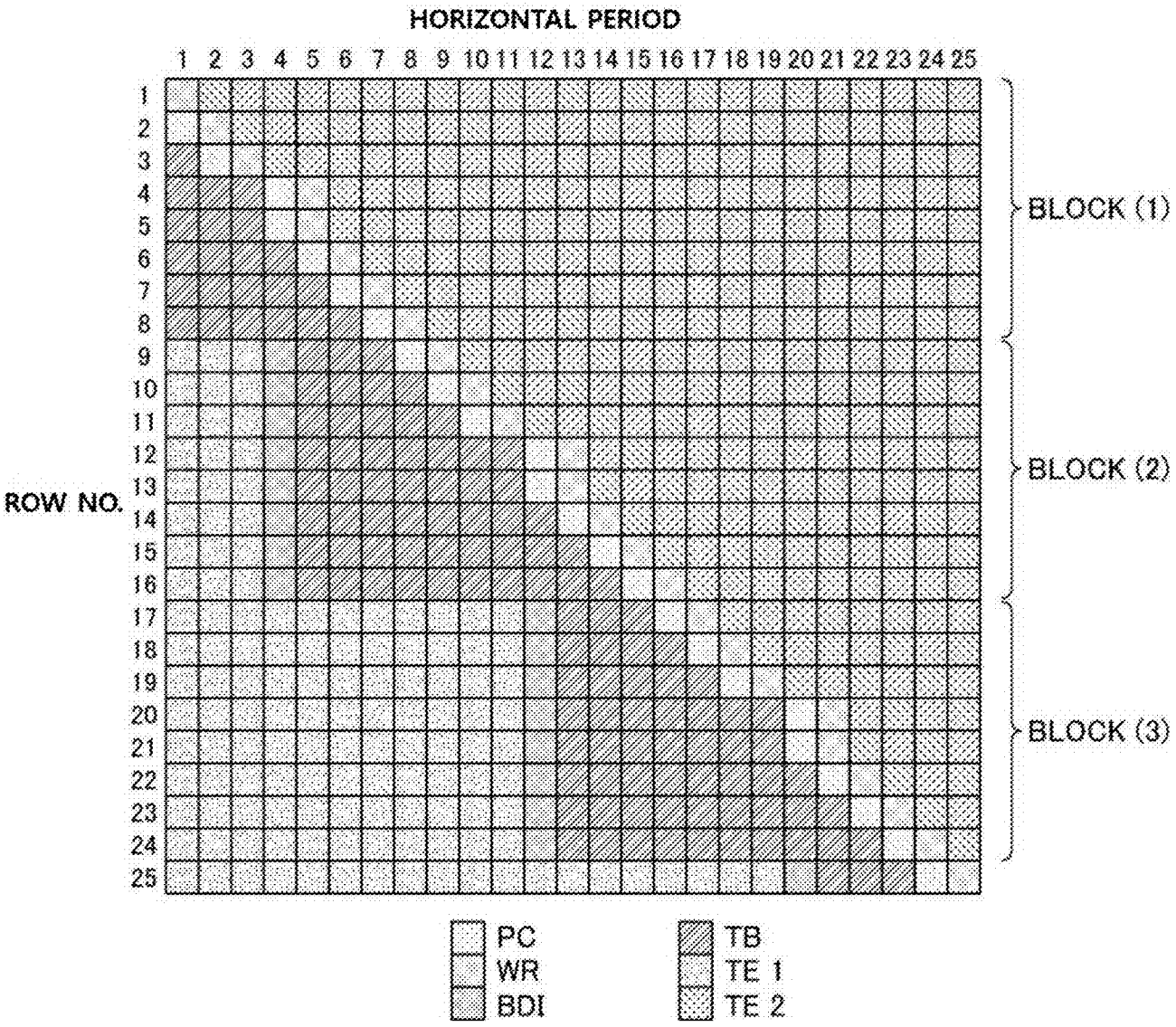
FIG. 13 is a view showing a display process in rows of a display device according to a fourth embodiment of the present disclosure.

FIG. 13 is a view showing a display process in rows of a display device according to a fourth embodiment of the present disclosure. In the horizontal period of 5, writing of the data voltage is performed in the pixels P of the fourth row and the fifth row of the first block BLOCK(1). In the horizontal period of 4, the black level voltage is performed in the pixels P of the ninth row to the sixteenth row of the second block BLOCK(2) and writing of the data voltage is not performed in the pixel P of the fourth row of the first block BLOCK(1). The pixel P of the fourth row of the first block BLOCK(1) emits a light of a luminance according to the data voltage for the fifth row. As a result, the same luminance is displayed in the fourth row and the fifth row of the display panel 10. Similarly, two rows among eight rows displays the same luminance in another block. Although an image different from an original image is displayed, the image according to the data voltage is displayed in most of rows. Accordingly, the two rows having the same luminance is rarely recognized. Therefore, the black data may be inserted according to the driving method of the fourth embodiment.

In the fourth embodiment, the display quality of a moving image is improved due to insertion of the black image and the sufficient writing time of the data voltage for image display is obtained. In addition, since a dark line of the first and second embodiments is not displayed, a display quality is further improved and reduction in luminance due to the dark line is prevented.

Although the fourth scan signal SCAN(4) for the pixel P of the fourth row has a high level at the same time with the scan signal for the pixel P of the adjacent row previous or next to the fourth rowing the third and fourth embodiments, the timing of a high level is not limited thereto. For example, the scan signal for at least one row may have a high level at the same time with the scan signal of the other row of the same block, and the same data voltage may be supplied to the pixels of the at least one row and the other row.

The structure of the display device 1 is exemplarily shown in the previous embodiments and is not limited thereto. For example, a part or all of functions of the display panel 10, the data driving circuit 20, the gate driving circuit 30 and the timing controller 40 may be integrated as a single unit.

Although the writing time period of the pixel P in the fourth row of the first block BLOCK(1) overlaps the black data inserting time period BDI in the first embodiment of FIG. 4, the overlap may be appropriately determined such that the black data inserting time period BDI overlaps the writing time period for the row different from the fourth row. In addition, the overlap may be changed by frame. When the overlap is changed by frame, the position of the dark line is changed by frame. As a result, the dark line is rarely recognized with the naked eyes, and the exterior display quality of the moving image is further improved.

Although the method of changing the overlap is not limited thereto, a method where the position of the dark line is irregularly or randomly changed is preferable to a method where the position of the dark line is changed from an upper portion or a lower portion according to the passage of frame. When the position of the dark line is sequentially changed along an upward direction or a downward direction, the dark line may be easily recognized with the naked eye. In the method where the position of the dark line is irregularly or randomly changed, the sequence may be determined by reading the sequence from a memory or by using random numbers.

In the second embodiment of FIG. 8, the third embodiment of FIG. 10 and the fourth embodiment of FIG. 12, the black data inserting time period BDI may be appropriately determined. The black data inserting time period BDI may be changed by frame and the exterior display quality of the moving image is further improved. In addition, a method where black data inserting time period BDI is irregularly or randomly changed by frame is preferable.

A relative timing of the black data inserting time period BDI, i.e., a gap between a start timing of a frame and the black data inserting time period BDI may be changed by frame. As a result, a change in display quality due to the black data insertion is rarely recognized with the naked eyes, and the exterior display quality of the moving image is further improved.

The driving method with the black data insertion according to one of the first to fourth embodiments and the driving method without the black data insertion may be changed by frame. For example, the driving method with the black data insertion according to one of the first to fourth embodiments may be performed when a moving image is displayed, and the driving method without the black data insertion may be performed when a static image is displayed. When the static image is displayed, necessity for improving a moving picture response time (MPRT) due to the black image insertion is reduced and the dark line is easily recognized with the naked eyes of a user.

A length of the emitting time period TE, i.e., an emission duty ratio may be changed by frame. The black data inserting time period BDI may have a different length according to a context of the moving image. As a result, the moving image may be displayed with a higher quality by changing the emission duty ratio. The emission duty ratio may be changed by changing a gap between the black data inserting time period BDI and the writing time period WR.

In the driving method of the first and second embodiments where the dark line is generated, since one row among eight rows has the dark line, the exterior display luminance may become ⅞ times and the exterior of an image may become dark. As a result, the original luminance may be displayed by increasing the luminance of the seven rows except for the row corresponding to the dark line. For example, the luminance variance due to the dark line may be exactly compensated by modifying the data voltage such that the luminance increases by a reciprocal of ⅞, i.e., 8/7. When the number of the rows of one block is p and the number of rows of one block corresponding to the dark line due to the black data is q, the display luminance variance may be accurately compensated by modifying the data voltage such that the luminance increases by p/(p−q) times.

Consequently, in the display device according to the present disclosure, the display quality of a moving image is improved due to insertion of the black image and the sufficient writing time of the data voltage for image display is obtained.

It will be apparent to those skilled in the art that various modifications and variation can be made in the present disclosure without departing from the spirit or scope of the disclosure. Thus, it is intended that the present disclosure cover the modifications and variations of this disclosure provided they come within the scope of the appended claims and their equivalents.

What is claimed is:

1. A display control device for controlling a display device including a display panel having a plurality of pixels arranged in a plurality of rows and a plurality of columns, comprising:

a first driving circuit configured to supply a data voltage corresponding to a luminance to the plurality of pixels by the plurality of columns; and a second driving circuit configured to select the plurality of pixels receiving the data voltage by the plurality of rows, wherein the plurality of rows are grouped into a plurality of blocks including at least a first block of rows and a second block of rows, wherein the first driving circuit and the second driving circuit are configured to, in one frame:

sequentially supply, in consecutive horizontal periods, the data voltage for an image display to the plurality of pixels in at least one row among the first block of rows and a black level voltage to the plurality of pixels in at least one other row among the first block of rows; and supply the black level voltage to the plurality of pixels in each of the second block of rows concurrently with supplying the black level voltage to the at least one other row among the first block of rows, and wherein the second driving circuit is configured to supply a scan signal having a width of two horizontal periods to the at least one of the first block of rows to supply the data voltage to the plurality of pixels in the at least one of the first block of rows.

2. The device of claim 1, wherein the first driving circuit is configured to modify the data voltage according to a total number of rows of the first block and a number of rows of the first block receiving the black level voltage.

3. The device of claim 2, wherein if the total number of rows of the first block is p and the number of rows of the first block receiving the black level voltage is q, the first driving circuit is configured to modify the data voltage such that the luminance increases by p/(p−q) times.

4. The device of claim 1, wherein the plurality of pixels in the at least one other row among the first block of rows supplied with the black level voltage is not supplied with the data voltage corresponding to the at least one row among the first block of rows during the one frame.

5. The device of claim 1, wherein the first block of rows and the second block of rows have a same total number of rows.

6. The device of claim 1, wherein a high level of a scan signal supplied to the plurality of pixels in each of the second block of rows overlaps a high level of a scan signal supplied to the plurality of pixels in the at least one other row among the first block of rows.

7. The device of claim 1, wherein the scan signal includes one high level during one frame.

8. The device of claim 1, wherein the scan signals overlap each other by one horizontal period.

9. A method of controlling a display device including a display panel having a plurality of pixels arranged in a plurality of rows and a plurality of columns, comprising:

supplying a data voltage corresponding to a luminance to the plurality of pixels by the plurality of columns; and selecting the plurality of pixels receiving the data voltage by the plurality of rows, wherein the plurality of rows are grouped into a plurality of blocks including at least a first block of rows and a second block of rows, and wherein the supplying of the data voltage and the selecting of the plurality of pixels include, in one frame:

sequentially supplying, in consecutive horizontal periods, the data voltage for an image display to the plurality of pixels in at least one row among the first block of rows and a black level voltage to the plurality of pixels in at least one other row among the first block of rows;

supplying the black level voltage to the plurality of pixels in each of the second block of rows concurrently with supplying the black level voltage to the at least one other row among the first block of rows; and supplying a scan signal having a width of two horizontal periods to the at least one of the first block of rows to supply the data voltage to the plurality of pixels in the at least one of the first block of rows.

10. The method of claim 9, wherein the plurality of pixels in the at least one other row among the first block of rows supplied with the black level voltage is not supplied with the data voltage corresponding to the at least one row among the first block of rows during the one frame.

11. A method of controlling a display device including a display panel having a plurality of pixels arranged in a plurality of rows and a plurality of columns, comprising:

supplying a data voltage corresponding to a luminance to the plurality of pixels by the plurality of columns; and selecting the plurality of pixels receiving the data voltage by the plurality of rows, wherein the plurality of rows are grouped into a plurality of blocks including at least a first block of rows and a second block of rows, and wherein the supplying of the data voltage and the selecting of the plurality of pixels include, in one frame:

sequentially supplying the data voltage for an image display to the plurality of pixels in at least one row among the first block of rows and supplying neither the data voltage nor a black level voltage to the plurality of pixels in at least one other row among the first block of rows;

supplying a black level voltage to the plurality of pixels in each of the second block of rows; and supplying a scan signal having a width of two horizontal periods to the at least one of the first block of rows to supply the data voltage to the plurality of pixels in the at least one of the first block of rows.

12. The method of claim 11, wherein a scan signal supplied to the plurality of pixels in the at least one other row among the first block of rows does not have a high level.

* * * * *